US008291819B2

(12) United States Patent
Bakker et al.

(10) Patent No.: US 8,291,819 B2
(45) Date of Patent: Oct. 23, 2012

(54) ROTARY ENDORSER FOR DOCUMENT PROCESSING EMPLOYING A SHAPE MEMORY ALLOY ACTUATOR

(75) Inventors: Johan P. Bakker, Brighton, MI (US); Philip D. Klug, Brighton, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 918 days.

(21) Appl. No.: 11/962,492

(22) Filed: Dec. 21, 2007

(65) Prior Publication Data

US 2009/0158945 A1 Jun. 25, 2009

(51) Int. Cl.
*B41L 47/46* (2006.01)

(52) U.S. Cl. ..... 101/91; 400/563; 235/3

(58) Field of Classification Search ..... 101/91, 101/586; 235/3, 58 R; 414/416.05
See application file for complete search history.

(56) References Cited

U.S. PATENT DOCUMENTS

| | | | | |
|---|---|---|---|---|
| 5,347,924 | A * | 9/1994 | Martin | 101/91 |
| 6,356,734 | B1 * | 3/2002 | Muir | 399/325 |
| 6,851,260 | B2 * | 2/2005 | Mernoe | 60/527 |
| 2003/0219330 | A1 * | 11/2003 | Lyndaker et al. | 414/411 |
| 2007/0210606 | A1 * | 9/2007 | Alacqua et al. | 296/97.8 |
| 2008/0138125 | A1 * | 6/2008 | Katayama | 399/324 |

FOREIGN PATENT DOCUMENTS

| | | |
|---|---|---|
| JP | 63-084969 | * 4/1988 |
| JP | 63-265274 | * 11/1988 |
| JP | 01-150566 | * 6/1989 |

* cited by examiner

*Primary Examiner* — Matthew G Marini
*Assistant Examiner* — Marissa Ferguson Samreth
(74) *Attorney, Agent, or Firm* — Honigman Miller Schwartz and Cohn LLP

(57) ABSTRACT

An actuation device for an endorsing roller in an automated document processing system is disclosed. The actuation device includes a shape memory alloy actuator interconnected with an endorsing roller, the shape memory alloy actuator interconnected with the endorsing roller and configured to be actuated to move the endorsing roller from a retracted position to a printing position.

11 Claims, 8 Drawing Sheets

ROTARY ENDORSER FOR DOCUMENT PROCESSING EMPLOYING A SHAPE MEMORY ALLOY ACTUATOR

TECHNICAL FIELD

The present disclosure relates generally to an endorser in a document processing system. In particular, the present disclosure relates to a rotary endorser for a document processing system employing a shape memory alloy actuator.

BACKGROUND

One hundred billion check-based transactions are made in the United States each year. Many of these check transactions are still cleared by physical processing and transporting of the original printed paper check. When checks are processed for payment, the routing and account information on the front of the check is read, and images are captured of the front and back sides of the check to capture information written on the check by a payor and any endorsements on the back of the check by the payee. Check processing systems at financial institutions do so by passing a large number of checks through large check processing systems to enter these checks into the financial systems computers for payment.

When checks or other documents are processed, in many cases endorsements must be printed on those documents. These endorsements will, for example, indicate when and where a document was processed, or provide an audit trail of processing. Certain endorsements, such as those printed on bank checks or other similar financial instruments, are required by statute.

Conventionally, endorsements are applied using ink-jet printing technology, a non-contact printing method which is useful in a variety of high-speed application of programmable messages. However, endorsements are increasingly used to apply an affirmative cancellation to the instrument. Therefore processing now often consists of applying an affirmative cancellation mark to the document which can be captured by a subsequent image scan. This endorsement indelibly marks the document, reflecting the fact that the document has been electronically converted and processed, and that the paper document is now worthless, with its value being transferred to the electronic transaction itself.

For printing such endorsements, conventional inkjet printing mechanisms have a variety of disadvantages. First, the programmability of inkjet printing mechanisms is unused when endorsing documents with a single fixed message, but that programmability must be paid for when inkjet systems are incorporated into endorsing systems. The programmability of inkjet printing mechanisms also introduces a security vulnerability into document processing systems. Additionally, inkjet ink is generally a fugitive substance which in theory could be eradicated using water or alcohol-based solvents, thereby allowing subsequent, fraudulent use of the financial document after it is endorsed.

Certain document processing systems operate using a print roller device to print a fixed-message endorsement on documents. Print rollers generally must be actuated between printing and retracted positions to control instances in which documents are marked. This actuation process typically requires some form of electromechanical actuator to perform it. Although in certain circumstances solenoids or other electric motors may be used in terms of the force and travel distance required these devices have a variety of disadvantages. For example, such electromechanical systems are generally not rated for the large number of cycles required in document processing machines—typically measured in millions of cycles. Furthermore, certain devices may be imprecise in both travel and force. Additionally, many devices tend to emit undesirable electrical or electromagnetic interference, which may disrupt the controlling electronics and require the use of added shields and/or filters, at added cost.

For these and other reasons, improvements are desirable.

SUMMARY

In accordance with the present disclosure, the above and other problems are solved by the following:

According to a first aspect, an actuation device for an endorsing roller in an automated document processing system is disclosed. The actuation device includes a shape member alloy actuator and configured to be actuated to move the endorsing roller from a retracted position to a printing position.

According to a second aspect, an automated document processing system is disclosed. The automated document processing system includes an endorsing roller moveable between a printing position adjacent to a path of travel of documents and a retracted position away from the path of travel. The automated document processing system also includes a shape memory alloy actuator interconnected with the endorsing roller and configured to be actuated to move the endorsing roller from the retracted position to the printing position.

According to a third aspect, a method of endorsing a document with an endorsing roller in an automated document processing system is disclosed. The method includes applying a current across a shape memory alloy wire of a shape memory alloy actuator. The method further includes moving an endorsing roller from a retracted position to a printing position in response to applying the current across the shape memory alloy wire.

According to a fourth aspect, a financial network employing an automated document processing system is disclosed. The network includes a computing system and an automated document processing system interfaced with the computing system. The automated document processing system includes an endorsing roller moveable between a printing position adjacent to a path of travel of documents and a retracted position away from the path of travel. The automated document processing system also includes a shape memory alloy actuator interconnected with the endorsing roller and is configured to be actuated to move the endorsing roller from the retracted position to the printing position.

DETAILED DESCRIPTION

Figure 1:
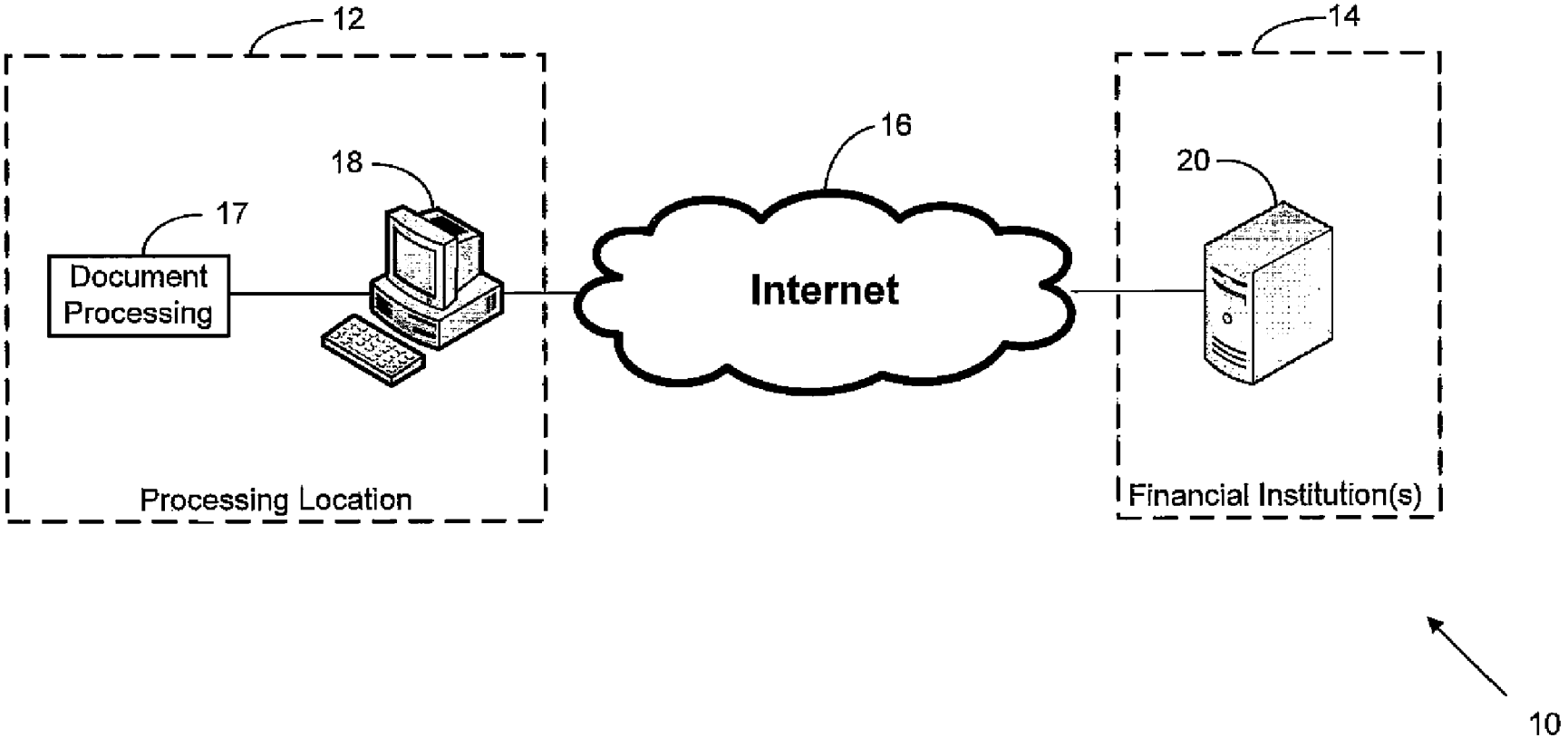
FIG. 1 is a schematic depiction of a network in which an electronic financial transaction may be placed, in accordance with the present disclosure.

Various embodiments of the present disclosure will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general, the present disclosure relates to a document reader, such as a check scanner. Specifically, the present disclosure relates to a rotary endorsing roller for a document processing system employing a shape memory alloy actuator. The shape memory alloy actuator is interconnected with an endorsing roller within an automated document processing system, and is configured to be actuated to move the endorsing roller from a retracted position to a printing position. A circuit useable in conjunction with the shape memory alloy actuator is also described.

One specific example of a document processing network in which the systems and methods of the present disclosure may be used is shown in FIG. 1. FIG. 1 illustrates a schematic view of a network 10 in which a financial transaction may take place, according to a possible embodiment of the present disclosure. The network 10 generally includes one or more document processing locations 12 and financial institutions 14, communicatively connected by a network, shown as the internet 16. A document processing location 12 may be any of a number of places of business at which a financial transaction may take processed, such as a location of a purchase or sale of goods and services, or a financial institution. In certain embodiments of the present disclosure, the document processing location 12 is a bank that processes a large number of checks for payment. Each document processing location 12 includes a document processing system 17 interconnected with a computing system 18. The document processing system 17 is arranged to provide the transaction location with the ability to electronically acquire information about a printed document, such as a check used for payment in exchange for goods and/or services. In certain embodiments, the document processing system 17 can include a check scanner and magnetic character reader, a printing device, and various sorting devices for capturing and/or printing information on one or both sides of a check. Example document processing systems useable in the network 10 are described below in conjunction with FIGS. 2-8.

The computing system 18 can be any of a number of types of computing systems, such as a general purpose personal computer, or a specialized computer such as a cash register or inventory system. The computing system 18 can interconnect with the document processing system 17 by any of a number of standard or specialized communication interfaces, such as a USB, 802.11a/g network, RF, infrared, serial, or other data connection. In certain embodiments, the computing system 18 runs an application configured to control the document processing system 17; in further embodiments, the computing system 18 receives data from the document scanner and stores and/or communicates the data (images, text, or other information) to other systems to which it is interconnected.

Each of the financial institutions 14 generally includes a computing system 20, which is configured to receive electronic records of financial transactions relevant to the financial institutions. The computing system 20 can be any of a number of types of computing systems capable of storing and managing financial transactions; in the embodiment shown, the computing system is a server system comprising one or more discrete computing units interconnected, as is known in the art.

The electronic records can be electronic transaction records, and can include scanned copies of documents memorializing financial transactions. In a particular example, an electronic record can reflect a purchase made with a check, in which the electronic record includes the relevant information on the face of the check, the routing and institution number printed on the check, and an image of one or more sides of the check, used to validate the other information and to display relevant endorsements of the check. Other electronically captured transactions, such as credit card transactions, contracts, or other negotiable instrument transactions may be tracked using the network 10 as well.

The internet connection 16 depicted can be any of a number of WAN, LAN, or other packet based communication networks such that data can be shared among a number of computing systems or other networked devices. Furthermore, although in the embodiment shown two computing devices 18, 20 at different, specific locations are depicted, the computing devices and/or the document processing system 17 may be located at the same location or within the same network.

Figure 2:
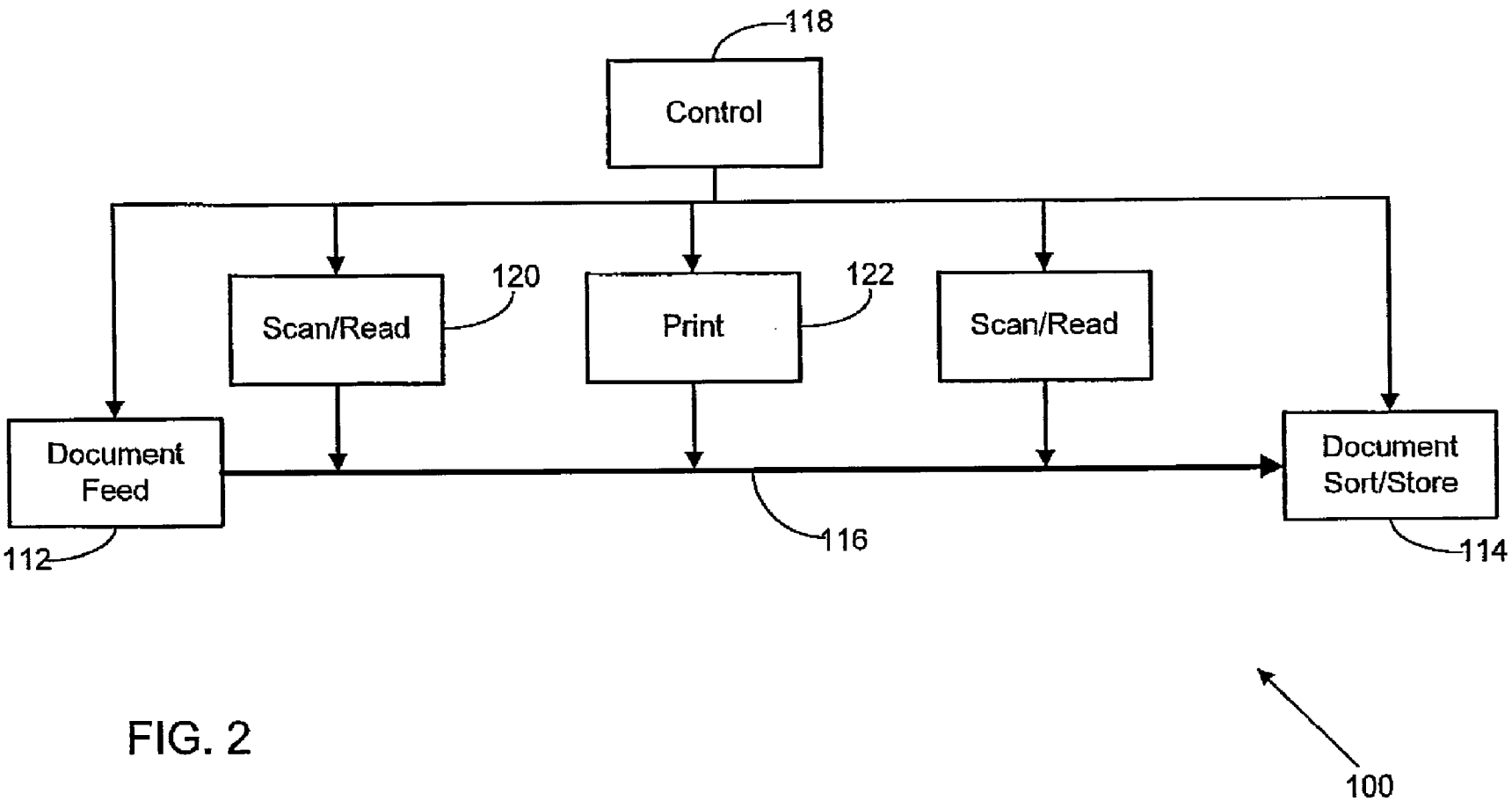
FIG. 2 is a schematic block diagram of an automated document processing system according to an embodiment of the present disclosure.

Referring now to FIG. 2, an automated document processing system 100 is shown within which aspects of the present disclosure may be implemented. The automated document processing system 100 provides an overview of the basic steps required to process documents, such as checks, in a high-volume system in which user supervision is minimized. The automated document processing system 100 can represent, for example, a possible embodiment of the document processing system 17 of FIG. 1.

In one embodiment, the automated document processing system 100 is a check processing system used to print and scan checks at a financial institution or document processing company. The automated document processing system 100 includes a document feeder 112 interconnected with a document sorter along a path of travel 116 of documents. The document feeder 112 is generally a document take-up mechanism provided with a large number of documents that are required to be processed. In a possible embodiment, the document feeder 112 receives 600 or more documents, such as checks, for processing. The document sorter 114 is an endpoint at which the documents have been processed, and can include one or more sorting mechanisms and/or document receiving apparatus configured to arrange physical documents in a desired manner. The document sorter 114 places processed documents into one or more pockets, each of the pockets holding a number of processed documents. Additional details regarding methods of use of the document sorter are described in detail below.

The path of travel 116 may be defined by any of a number of document movement and/or guiding mechanisms, such as rollers, guides, or other systems able to grip and move documents from the document feeder 112 to the document sorter 114. A control system 118 is interconnected to the document feeder 112 and the document sorter 114 to control flow of documents along the path of travel 116. The control system 118 can be an application level program configured to control flow and processing of documents. The control system 118 can reside on a general purpose or specific purpose computing system capable of communicating with the document feeder 112 and document sorter 114.

The control system 118 further directs a scanning system 120 and a printing system 122. The scanning system 120 can scan one side of the documents passing along the path of travel 116, to store text and/or images displayed on the documents. The printing system 122 prints desired characters and/or images onto documents passing by the printing system along the path of travel 116. The printing system 122 can incorporate a print assembly which is configured to print from a stationary printing aperture onto moving documents passing by the printing system along the path of travel. In the example of a check processing system, the printing system 122 can print an endorsement onto the back of a check which is being processed at a financial institution operating the automated document processing system 100. Other documents may be processed as well, by financial institutions or other document processing entities.

Other functionalities may be incorporated along the path of travel 116, such as additional scanning, printing, or character reading systems. The existence of any of these additional systems is a matter of system configuration, depending upon the needs of the institution using the system.

By passing documents through the automated document processing system 100, a large volume of documents can be printed and electronically captured, such that various records can be stored for each of a large number of documents. In the case of a financial institution processing checks or other documents, that institution can endorse a large number of checks, can capture check images and routing information, and can appropriately sort the document for distribution back to the issuing institution of the check.

Figure 3:
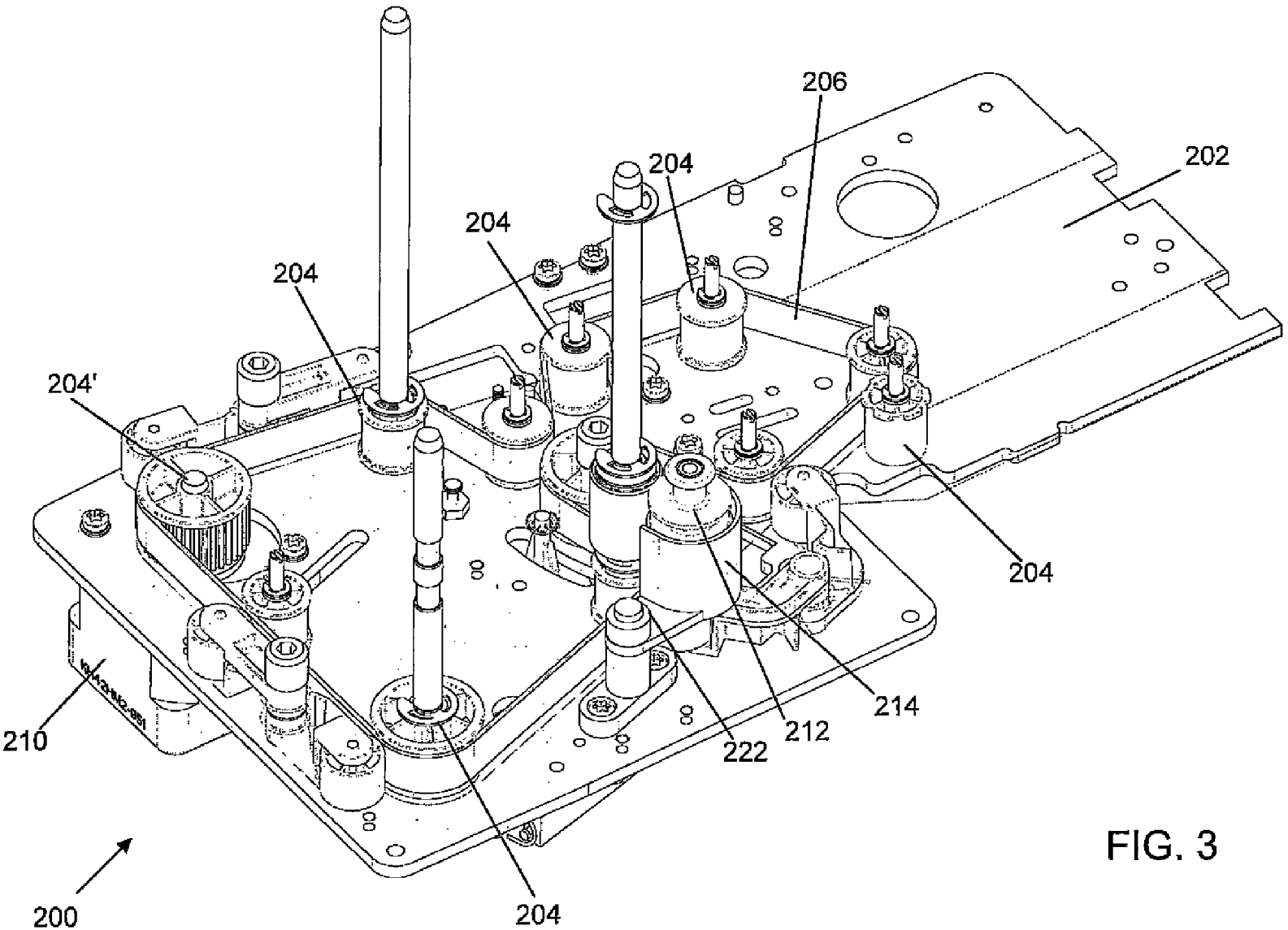
FIG. 3 is a top perspective view of a portion of an automated document processing system in which aspects of the present disclosure may be implemented.

Referring now to FIG. 3, a portion of an automated document processing system 200 is shown in which aspects of the present disclosure may be implemented. The automated document processing system 200 can, in certain embodiments, represent a possible embodiment of the automated document processing system 100 of FIG. 2. The automated document processing system 200 includes a base plate 202 upon which a variety of document processing components may be mounted. The base plate 202 is generally arranged to provide a base upon which a plurality of document processing components can be mounted. A plurality of rollers 204 provide a path upon which a belt 206 is mounted. The belt 206 and rollers 204 define a path of travel 208 (seen in FIGS. 6-7) for documents passing through the automated document processing system. A motor 210, such as an electrical stepper motor or other electrical motor type, rotates a roller 204' directly connected to the motor, thereby causing the belt 206 to drive the other rollers 204 and advance documents located within the path of travel 208 in the automated document processing system 200. Due to movement of the motor 210, the belt 206 rotates in a counterclockwise direction as shown in FIG. 3, with documents passing from an intake generally placed at the upper righthand portion of the system 200 and traveling past roller 204' and around the rollers generally in the path of the belt 206 (except in locations along the path of travel 208 in which the belt 206 is withdrawn from the path).

In various embodiments, different types of components may be incorporated into the automated document processing system 200. For example, the automated document processing system 200 can include a scanning device, a magnetic character reading device, a variable-printing endorser, a rear image scanning device, and other systems. These systems can be mounted to the base plate 202 adjacent to the rollers 204 and belt 206.

In the embodiment shown, tie automated document processing system 200 includes an endorsing roller 212 mounted adjacent to the path of travel 208. The endorsing roller 212 is generally a cylindrical device of a porous elastomer material and holding a relatively non-fugitive ink. The outer circumference of the roller 212 includes a print screen arrangement to print a recognizable message or image. The roller 212 prints the same fixed message for as long as it remains in contact with the paper. The endorsing roller 212 is surrounded on non-printing sides with a guard 214, which prevents the endorsing roller from contacting other portions of the document processing system.

The endorsing roller 212 is mounted onto a movable carriage 222, as described in greater detail below, which is retractable away from the path of travel during instances in which a document need not be endorsed. Additional details regarding movement of the endorsing roller between retracted and printing positions are described below, with the endorsing position shown in FIG. 6 and the retracted position shown in FIG. 7.

Figure 4:
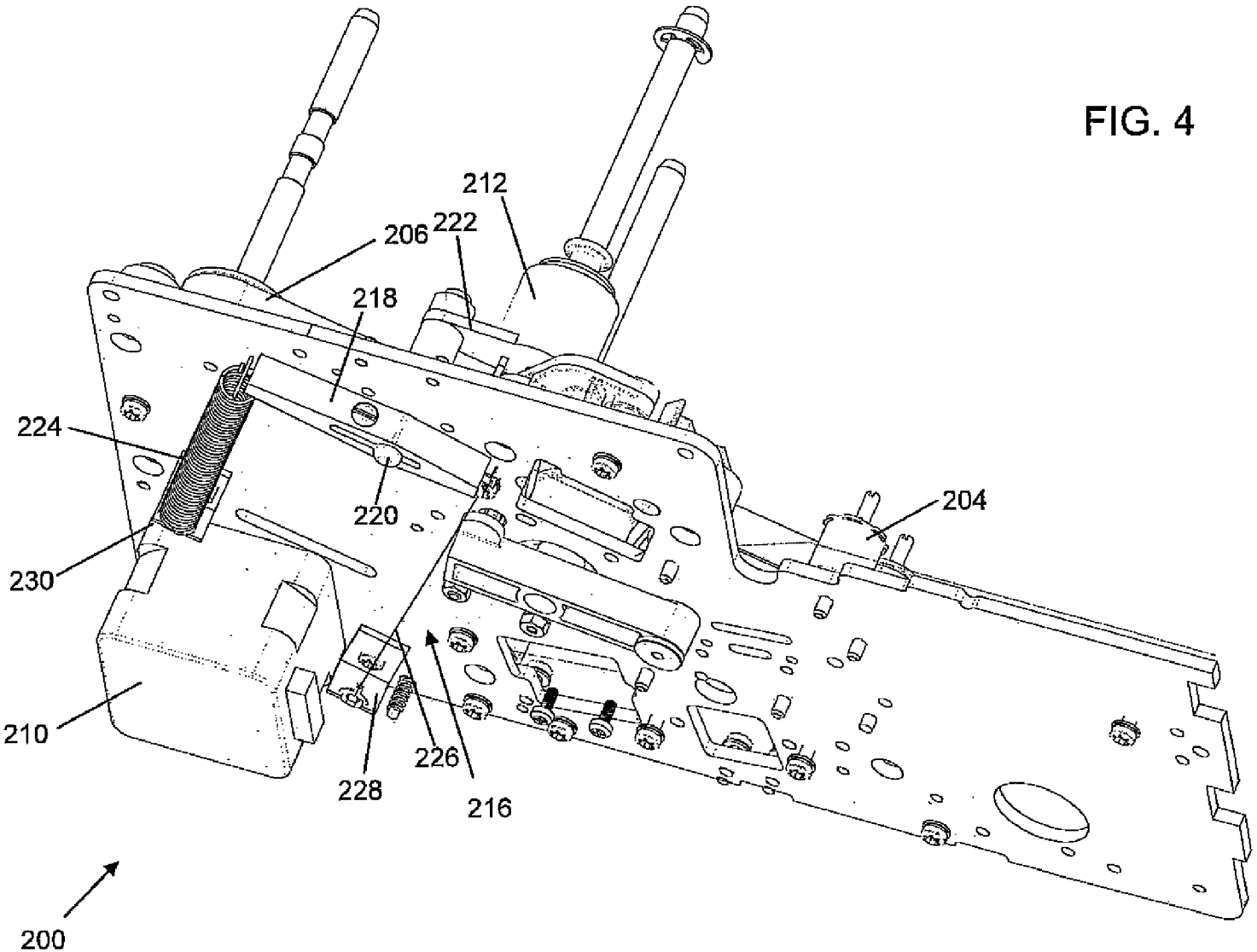
FIG. 4 is a bottom perspective view of the portion of the automated document processing system of FIG. 3.
Figure 5:
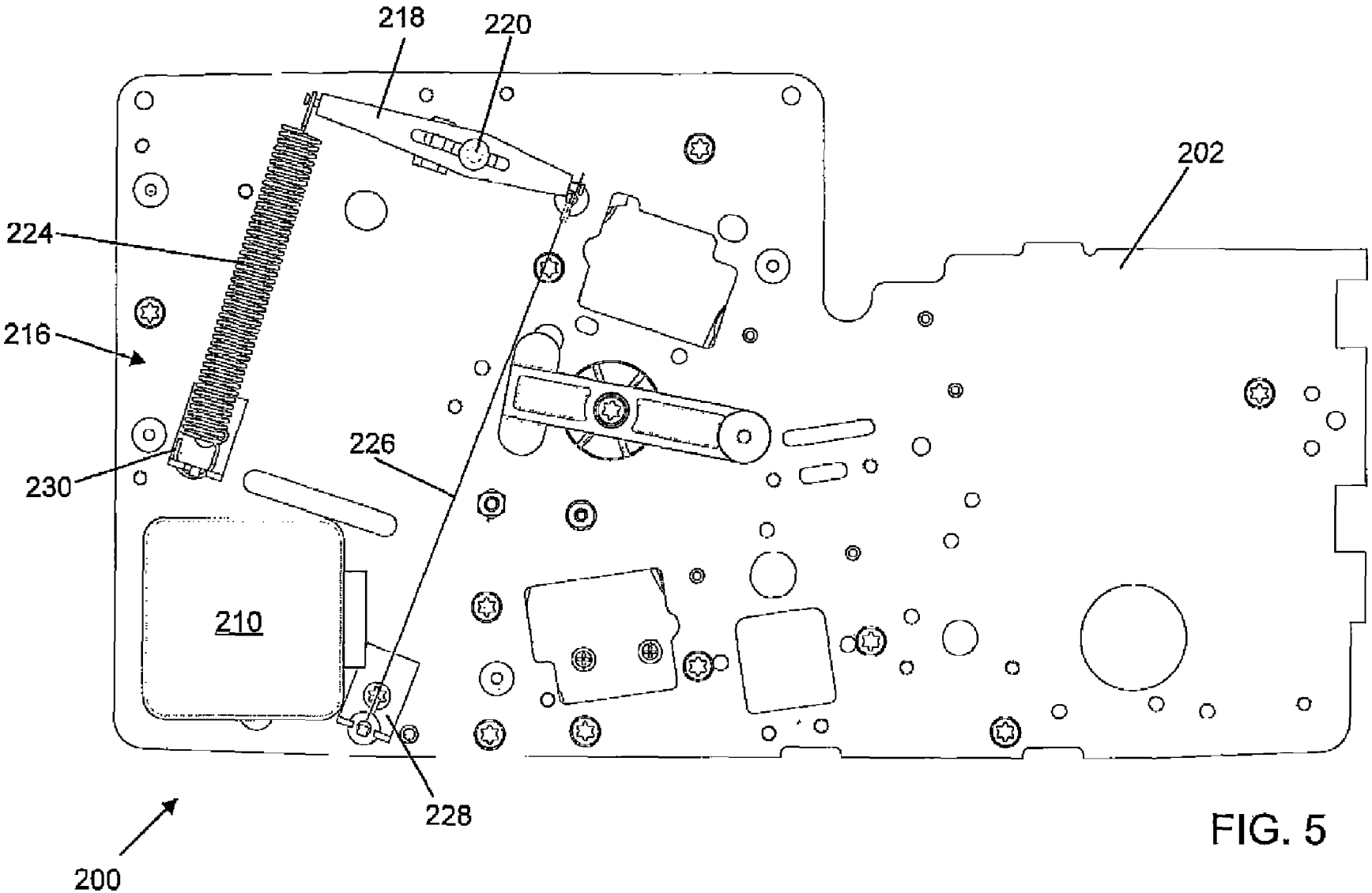
FIG. 5 is a bottom view of the automated document processing system of FIG. 3.

FIGS. 4-5 show bottom views of the automated document processing system 200 of FIG. 3. These figures show an actuator 216 mounted to the bottom surface of the base plate 202 and used to move the endorsing roller 212 between the retracted and printing positions within the automated document processing system 200. The actuator 216 includes a lever arm 218 having a pivot point 220. The pivot point 220 connects to a carriage 222 holding the endorsing roller 212 on the top side of the base plate 202, such that, as the lever arm 218 is pivoted, the carriage 222 also pivots about the pivot point 220 causing the endorsing roller to move between printing and retracted positions. The lever arm 218 is affixed at opposite ends by a spring 224 and a wire 226.

In the embodiment shown, the wire 226 is connected from an end of the lever arm 218 to a fixed bracket 228 mounted to the bottom surface of the base plate 202 near the motor 210. The wire 226 is made from a shape memory alloy, such as a nickel and titanium alloy, a copper-zinc-aluminum-nickel alloy, a copper-aluminum-nickel alloy, or other alloys, change volume upon a change between the austenitic and martensitic phases of the material structure. By adjusting the alloying and heat-treatment of the material used in the wire 226, the temperature at which this change occurs can be adjusted with precise limits. By other, similar adjustments, the amount and nature of the volume change can likewise be tailored to produce actuator forces. Using these variables, an effective print actuator drive force can be created by forming the material into suitable shapes, and heating/cooling it through the phase change temperature, such as by passing electric current through the material itself.

Shape memory alloys are available having phase-change temperatures in the range of 60° C.-100° C. (160° F.-212° F.), and which exhibit a volume reduction of ±4% when passed through the phase-change temperature from a lower temperature to a higher temperature. This volume change is reversed when the alloy is passed through that same phase change temperature from a higher temperature to a lower temperature. The material is capable of exerting a stress in the order of 25,000 psi as a result of this volume reduction. Such materials are widely available at low cost, e.g. 'Flexinol' wire materials, a product of Dynalloy, Inc.

In one possible embodiment, the wire 226 is a cylindrical wire having diameter of about 0.006", length of about 6.00" and phase-change temperature of about 70° C. The wire 226 can be heated from an ambient temperature of about 20-30° C. (in free air) to above the phase-change temperature by the application of a DC current in the order of about 3-5 volts and about 50-150 milliamperes through its length. Details regarding a possible circuit for use in inducing a current in the wire 226 are described in greater detail below in conjunction with FIG. 8.

When heated by use of an electrical current, the wire 226 contracts, exerting a tensile force pulling the lever arm 218. When the current is removed, the wire 226 sheds heat to the atmosphere due to the large thermal gradient between the wire and the surrounding air, and cools to below the phase-change temperature. When the wire 226 cools to below the phase change temperature, it returns to its original length. In one embodiment the wire 226 contracts by approximately 0.240" from its original length, causing approximately 11 ounces of tensile force on the lever arm. According to other various embodiments, selection of a specific current to be applied to the wire allows control over the speed of actuation and de-actuation, but not its force, which is a fixed function of the specific alloy chosen. In various other embodiments, the actuating force can be adjusted through selection of wire diameter.

The spring 224 is connected to a second bracket 230 mounted to the base plate 202 near the motor 210. The spring 224 counteracts the force applied by the wire 226, allowing the endorsing roller 212 to return to the retracted position upon extension of the wire 226 (e.g. by discontinuing current passing through the wire). The spring additionally counteracts the high tensile force created using the wire 226, thereby causing a lower net force to act upon the endorsing roller 212, moving that roller to the printing position.

Figure 6:
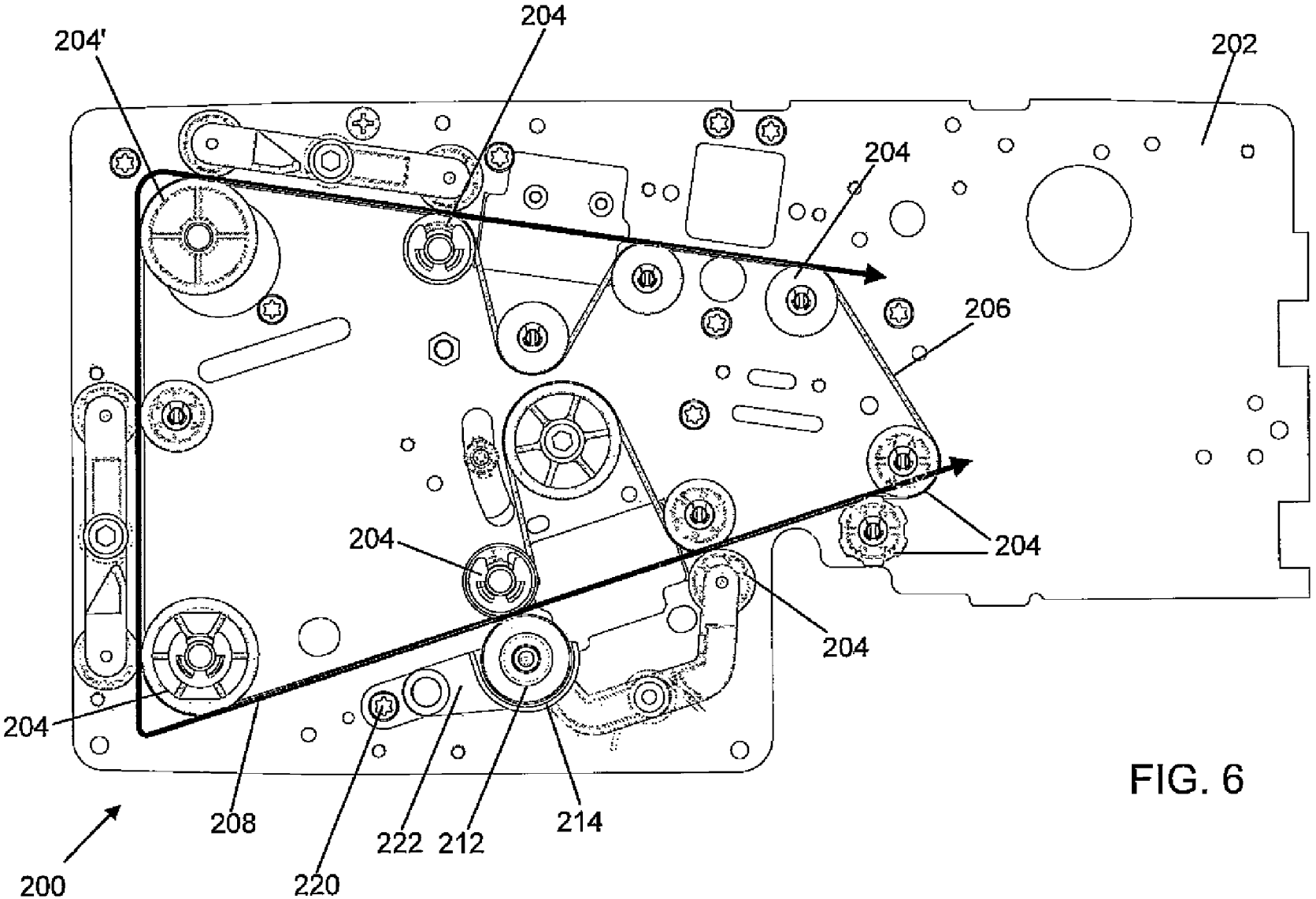
FIG. 6 is a top view of the automated document processing system of FIG. 3 in a printing position.
Figure 7:
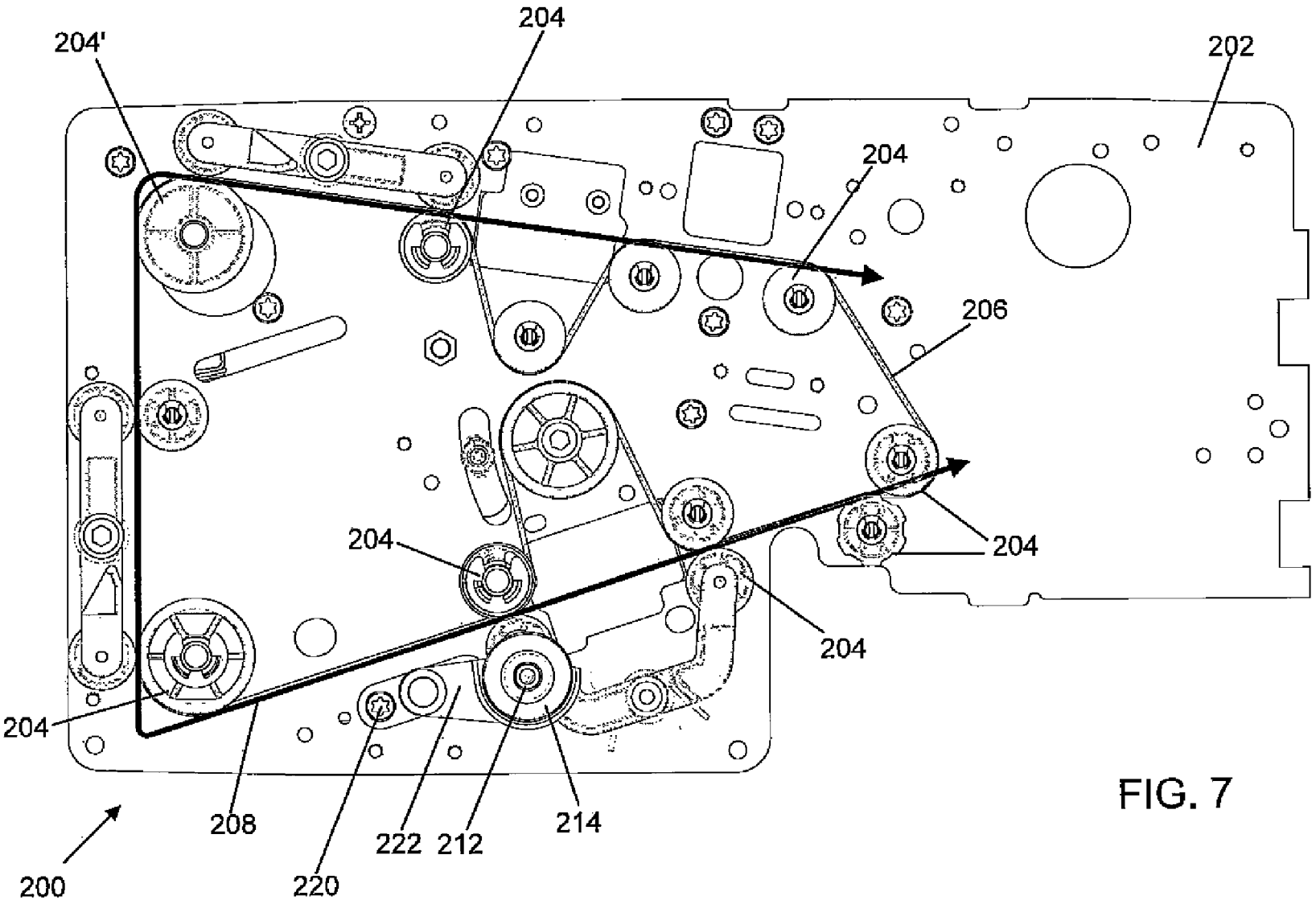
FIG. 7 is a top view of the automated document processing system of FIG. 3 in a retracted position.

FIGS. 6-7 are top views of the automated document processing system 200 of FIG. 3 with the endorsing roller 212 in a printing position and a retracted position, respectively. In FIG. 6, the endorsing roller 212 is moved to a printing position by applying a current through the actuating wire 226 such that the carriage 222 is pivoted toward the path of travel 208 such that endorsing roller 212 is adjacent to the path of travel (as defined by the opposing roller 204 and belt 206). In FIG. 7, the endorsing roller 212 is moved to a retracted position by removing the current from the actuating wire 226 and allowing the spring 224 to pivot the lever arm 218 and attached carriage 222 such that the endorsing roller is moved approximately a quarter inch away from the path of travel 208, in a direction generally normal to the path of travel.

Use of the shape memory alloy wire 226 in conjunction with the spring provides a number of advantages in actuating the endorsing roller 212 between the printing position and the retracted position. Applying current to the shape memory alloy wire 226 does not cause emission of electromagnetic radiation. Furthermore, the extent and force of the movement can be tailored carefully as a function of the current applied, as well as the size and materials used for the wire 226. Additionally, the actuation mechanism is substantially silent, and can be built for a cost substantially lower than through use of traditional actuating motors or solenoids.

Figure 8:
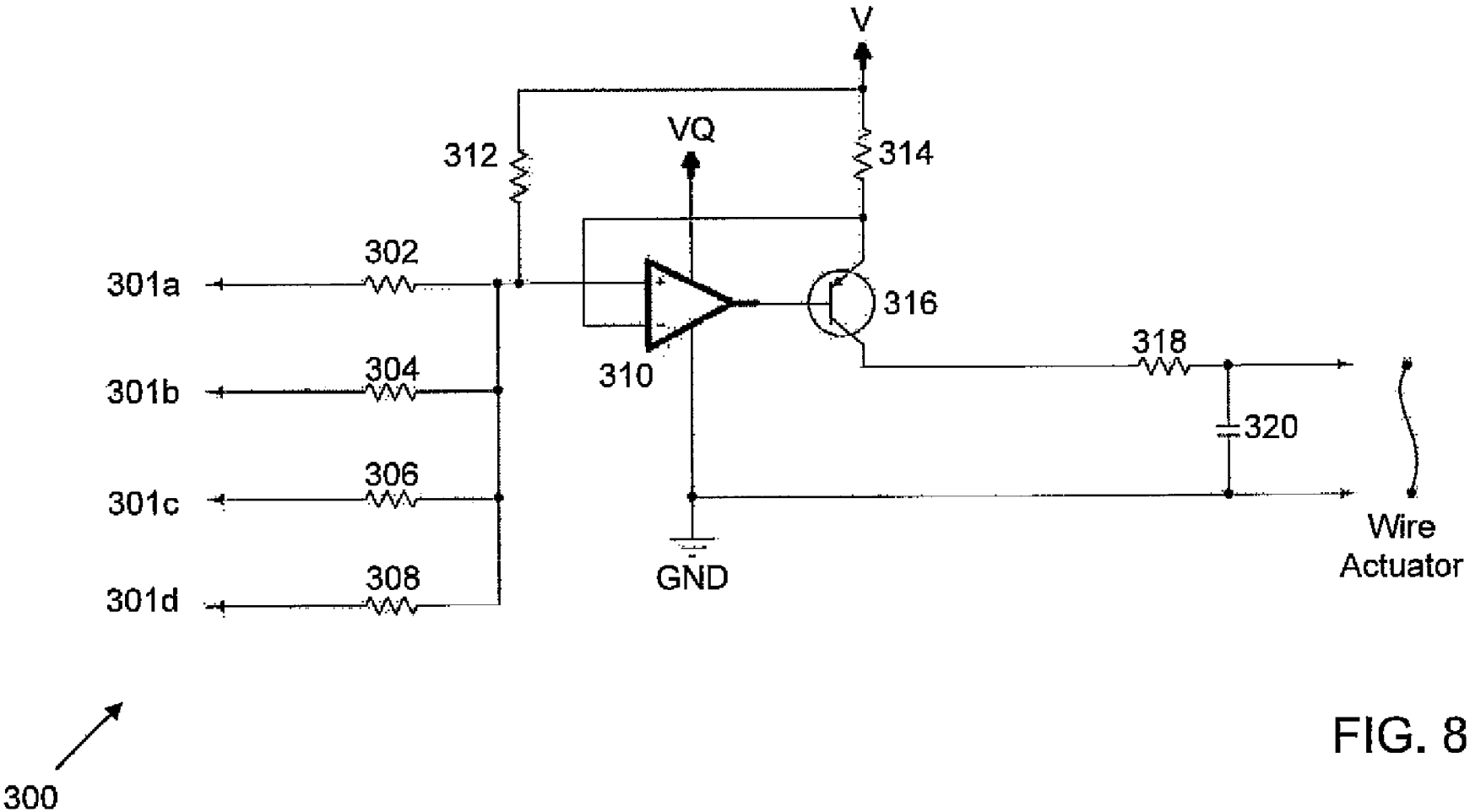
FIG. 8 is a schematic diagram of a circuit used to electrically actuate movement of the roller in a document management system according to an embodiment of the present disclosure.

FIG. 8 is a schematic diagram of a circuit 300 useable to electrically actuate movement of the roller in a document management system according to an embodiment of the present disclosure. In the embodiment shown, the circuit 300 provides an interface by which a personal computer can control the position of the endorsing roller 212 of the automated document processing system 200 of FIGS. 3-7. In the embodiment shown, an interface having four control lines 301*a-d* is provided to the external computing system, which can lead from a four-bit parallel data interface as received from a microcontroller integrated into the document processing system or via a connector into the system. Each of the four control lines 301*a-d* includes a resistor 302, 304, 306, 308, respectively, the values of which are selected to provide different voltages at an input to an operational amplifier 310. These resistors 302-308 can be attached to a microprocessor or other I/O controller to set the various bit combinations. The values of the resistors 302-308 are selected such that the voltage response of the operational amplifier 310 is linear, non-linear, or some custom response.

The operational amplifier 310 connects to a source voltage VQ and a ground G. The positive terminal of the operational amplifier 310 is also connected to a voltage source V via a resistor 312. The resistor 312 prevents current from passing through the shape memory alloy wire actuator if no logic input is applied to the control lines 301*a-d*.

The voltage source V, which provides the current that is supplied to the shape memory alloy wire, is also connected to the negative terminal of the operational amplifier 310 by a resistor 314. The negative terminal of the operational amplifier is connected to an emitter of a transistor 316, shown as an NPN BJT-type transistor in the embodiment of FIG. 8. The common terminal of the transistor 316 connects through a resistor 318 to one end of a wire actuator, which completes the circuit by connecting to ground.

The output of the operational amplifier 310 is connected to a base of a transistor 316, and acts as a switch regarding the output of the transistor 316. The operational amplifier 310 will drive the base of the transistor 316 so that the voltage at the emitter of the transistor matches that at the positive terminal of the operational amplifier. The voltage drop across resistor 314 divided by the value of that resistor determines the current flowing through the nitinol wire actuator.

A capacitor 320 connects in parallel to the shape memory alloy wire actuator, and acts in conjunction with resistor 318 to form an RC circuit whose time constant determines the current rise and fall times through the shape memory alloy wire actuator.

Through use of the circuit 300, a user of a programmable circuit or personal computer interfaced to an automated document processing system can programmably direct different amounts of current through the shape memory alloy actuator of the document processing system described herein by selectively applying different four bit input combinations on the control lines 301*a-d*. Although specific currents are a matter of design choice, in general greater inputs (e.g. '1111' instead of '0001') will result in a larger current applied to the shape memory alloy wire actuator, when holding constant the characteristics of the resistive, capacitive, and other elements in the circuit 300.

It is understood that although one possible circuit is shown in FIG. 8, other circuits or variations of this circuit may be possible in various other embodiments of the present disclosure. For example, a pushbutton switch or electrical switching system may be used to activate a circuit, allowing one or more possible current levels through the shape memory alloy wire.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. An apparatus, comprising:

an automated document processing system including an endorsing roller and a base plate, wherein the endorsing roller is arranged upon an upper surface of the base plate; and an actuation device arranged upon a lower surface of the base plate and in communication with the endorsing roller that is arranged upon the upper surface of the base plate, wherein the actuation device includes:

a bracket that is fixed to the lower surface of the base plate, a lever arm including a first end and a second end that is movably-arranged upon the lower surface of the base plate, wherein the lever arm is connected to the endorsing roller, a spring connected to the first end of the lever arm, and a shape memory alloy actuator including a first end and a second end, wherein the first end of the shape memory actuator is connected to the bracket, wherein the second end of the shape memory alloy actuator is connected to the second end of the lever arm.

2. The apparatus of claim 1, wherein the shape memory alloy actuator includes a shape memory alloy wire.

3. The apparatus of claim 1, further comprising a circuit connected to the shape memory alloy actuator and configured to actuate the shape memory alloy wire in response to an input.

4. The apparatus of claim 3, wherein the input comprises a four bit digital signal.

5. The apparatus of claim 3, wherein the circuit is connected across the shape memory alloy actuator and induces a current in the shape memory alloy wire in response to the input.

6. The apparatus of claim 3, wherein the input provides an interface to a computing system external to the automated document processing system.

7. The apparatus of claim 1, further comprising a guard arranged upon the upper surface of the base plate and arranged around a portion of the circumference of the endorsing roller.

8. A method, comprising the steps of:

connecting a shape memory alloy wire to an endorsing roller of an automated document processing system;

arranging the endorsing roller in a default, retracted position;

changing an orientation of the endorsing roller from the default, retracted position to an engaged, printing position to permit endorsement of a document that is interfaced with the automated document processing system by:

contracting a length of a shape memory alloy wire in response to an application of a current across the shape memory alloy wire.

9. The method of claim 8 further comprising the step of:

changing the orientation of the endorsing roller from the engaged, printing position back to the default, retracted position by:

expanding the length of the shape memory alloy wire in response to a removal of the current across the shape memory alloy wire.

10. The method of claim 8 further comprising the step of:

receiving an input at a circuit connected across the shape memory alloy wire, wherein the input is received from a computing system interfaced with the automated document processing system.

11. A financial network, comprising:

a computing system; and an automated document processing system interfaced with the computing system, wherein the automated document processing system includes:

an endorsing roller and a base plate, wherein the endorsing roller is arranged upon an upper surface of the base plate, and an actuation device arranged upon a lower surface of the base plate and in communication with the endorsing roller that is arranged upon the upper surface of the base plate, wherein the actuation device includes:

a bracket that is fixed to the lower surface of the base plate, a lever arm including a first end and a second end that is movably-arranged upon the lower surface of the base plate, wherein the lever arm is connected to the endorsing roller, a spring connected to the first end of the lever arm, and a shape memory alloy actuator including a first end and a second end, wherein the first end of the shape memory actuator is connected to the bracket, wherein the second end of the shape memory alloy actuator is connected to the second end of the lever arm.

* * * * *